US008381415B1

(12) United States Patent
Lanoue et al.

(10) Patent No.: US 8,381,415 B1
(45) Date of Patent: Feb. 26, 2013

(54) FLIP-FLOP BACK STRAP DEVICE

(76) Inventors: Wanda J. Lanoue, Pascoag, RI (US); Jennifer Pelland, Harrisville, RI (US)

( * ) Notice: Subject to any disclaimer, the term of this patent is extended or adjusted under 35 U.S.C. 154(b) by 266 days.

(21) Appl. No.: 12/832,407

(22) Filed: Jul. 8, 2010

(51) Int. Cl.
*A43B 3/12* (2006.01)

(52) U.S. Cl. ..... 36/11.5; 36/58.5

(58) Field of Classification Search ..... 36/11.5, 36/58.5, 58.6
See application file for complete search history.

(56) References Cited

U.S. PATENT DOCUMENTS

| | | | | |
|---|---|---|---|---|
| 2,112,761 | A * | 3/1938 | Buehner | 36/11.5 |
| 3,482,337 | A * | 12/1969 | Granek | 36/11.5 |
| 3,928,927 | A * | 12/1975 | Brown et al. | 36/11.5 |
| D336,358 | S | 6/1993 | Hatfield | |
| 5,992,058 | A | 11/1999 | Jneid | |
| 6,516,538 | B2 | 2/2003 | Kraft | |
| 7,146,751 | B2 * | 12/2006 | Seamans | 36/50.1 |
| 7,331,122 | B2 | 2/2008 | Januszewski et al. | |
| 7,439,837 | B2 | 10/2008 | McDonald | |
| 7,802,382 | B2 * | 9/2010 | Eades et al. | 36/136 |
| 7,823,302 | B2 * | 11/2010 | Mann et al. | 36/136 |
| 2005/0252036 | A1 * | 11/2005 | Laska | 36/11.5 |
| 2006/0288610 | A1 * | 12/2006 | Laska et al. | 36/11.5 |
| 2008/0110057 | A1 * | 5/2008 | Eades et al. | 36/105 |
| 2008/0155855 | A1 * | 7/2008 | Klavano | 36/11.5 |
| 2008/0189984 | A1 * | 8/2008 | Januszewski et al. | 36/100 |
| 2010/0018079 | A1 * | 1/2010 | Albert | 36/101 |

* cited by examiner

*Primary Examiner* — Marie Patterson

(57) ABSTRACT

A flip-flop system featuring an elongated strap between about 6 to 10 inches in length; a first half snap disposed on the outer surface of the strap at the first end and a second half snap disposed on the outer surface of the strap near the first end, the first half snap can engage the second half snap by bending the first end of the strap around; and a third half snap disposed on the outer surface of the strap at the second end and a fourth half snap disposed on the outer surface of the strap near the second end, the third half snap can engage the fourth half snap by bending the second end of the strap around, the snaps function to the elongated strap to be removably attached to a flip-flop, sandal, or thong.

2 Claims, 3 Drawing Sheets

FLIP-FLOP BACK STRAP DEVICE

FIELD OF THE INVENTION

The present invention is directed to an accessory for flip-flops, thongs, sandals, and the like, more particularly to a back strap device that helps secure the flip-flops, thongs, or sandals to the user's foot.

BACKGROUND OF THE INVENTION

It is often much more comfortable to wear flip-flops than heavy or bulky athletic shoes. However, when wearing flip-flops, one may not be able to engage in various activities such as but not limited to sports that require that an individual's shoes stay securely fastened to his/her feet. And, many places such as schools and amusement parks have regulations on the types of shoes that an individual wears. The present invention features a back strap device for flip-flops, thongs, sandals, and the like. The back strap helps to keep the flip-flop secured to the user's foot. The back strap device of the present invention provides a means of wearing a comfortable and fashionable flip-flop or sandal that also meets requirements for sports, amusement parks, and schools. Individuals would not then be required to carry an additional pair of athletic shoes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a flip-flop system. In some embodiments, the system comprises an elongated strap having a first end, a second end, an outer surface, and an inner surface, the elongated strap being between about 6 to 10 inches in length as measured from the first end to the second end; a first half snap disposed on the outer surface of the strap at the first end and a second half snap disposed on the outer surface of the strap near the first end spaced a certain distance away from the first half snap, the first half snap can engage the second half snap by bending the first end of the strap around; and a third half snap disposed on the outer surface of the strap at the second end and a fourth half snap disposed on the outer surface of the strap near the second end spaced a certain distance away from the third half snap, the third half snap can engage the fourth half snap by bending the second end of the strap around, the snaps function to the elongated strap to be removably attached to a flip-flop, sandal, or thong. The elongated strap may be adjustable in length.

DESCRIPTION OF PREFERRED EMBODIMENTS

Figure 1:
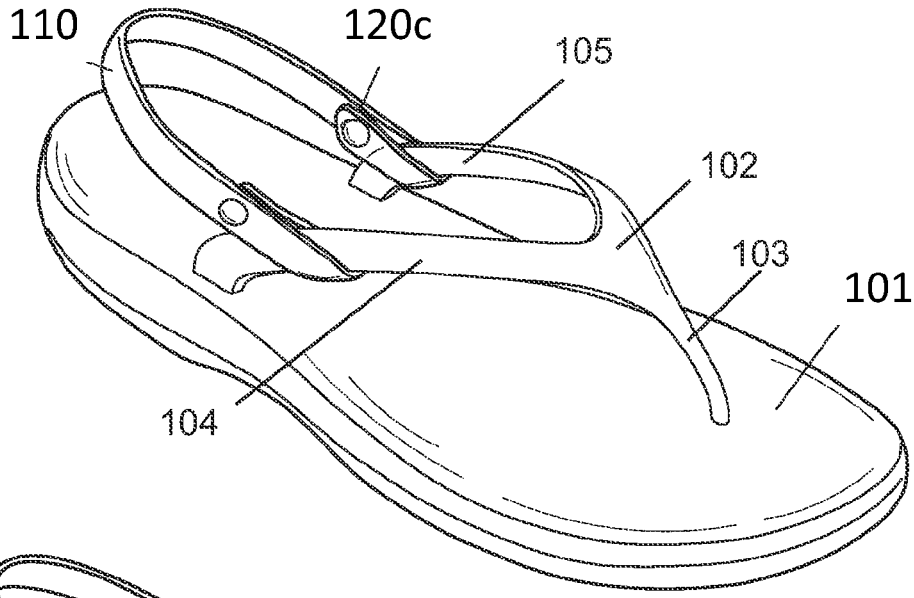
FIG. 1 is a perspective and in-use view of the back strap device of the present invention.
Figure 2:
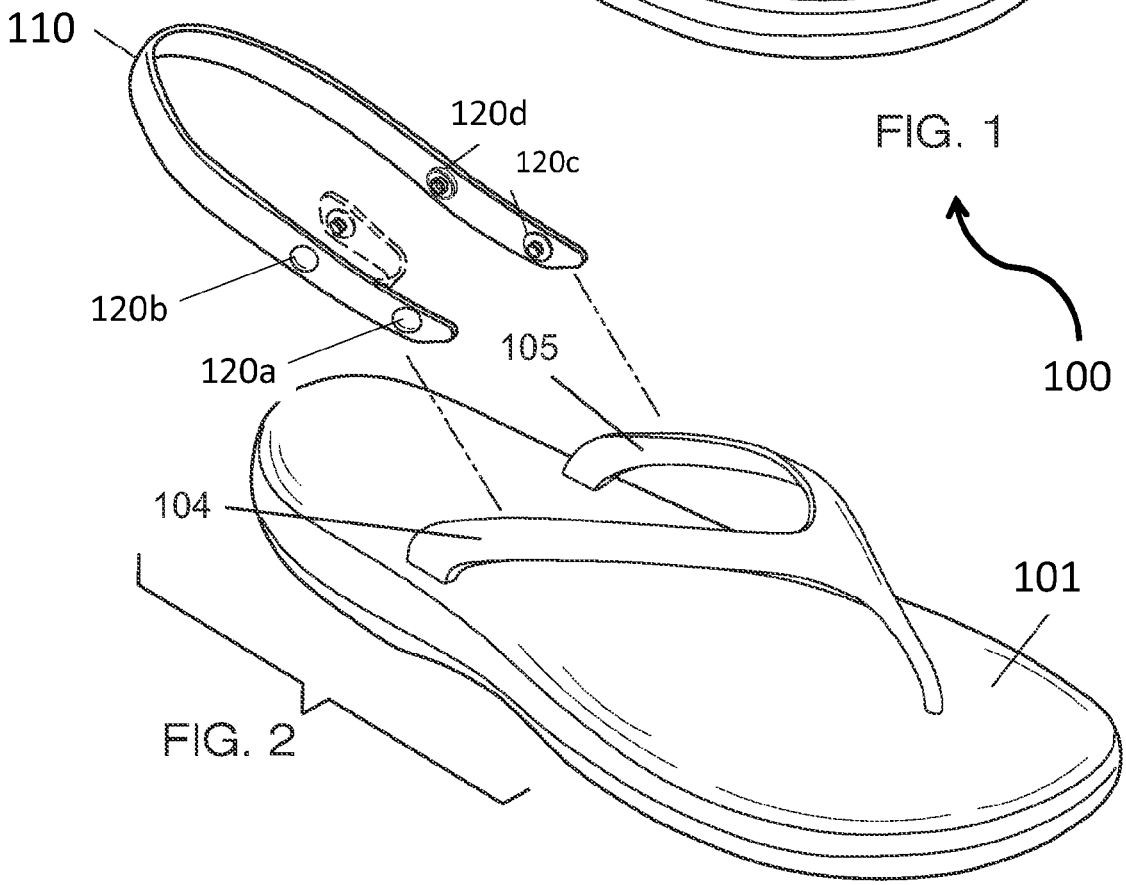
FIG. 2 is an exploded view of the back strap device of FIG. 1.
Figure 3:
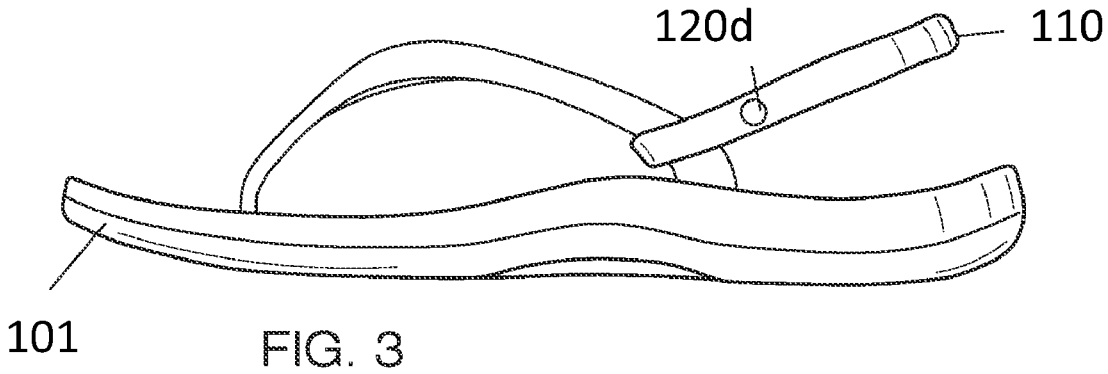
FIG. 3 is a side view of the back strap device of FIG. 1.
Figure 4:
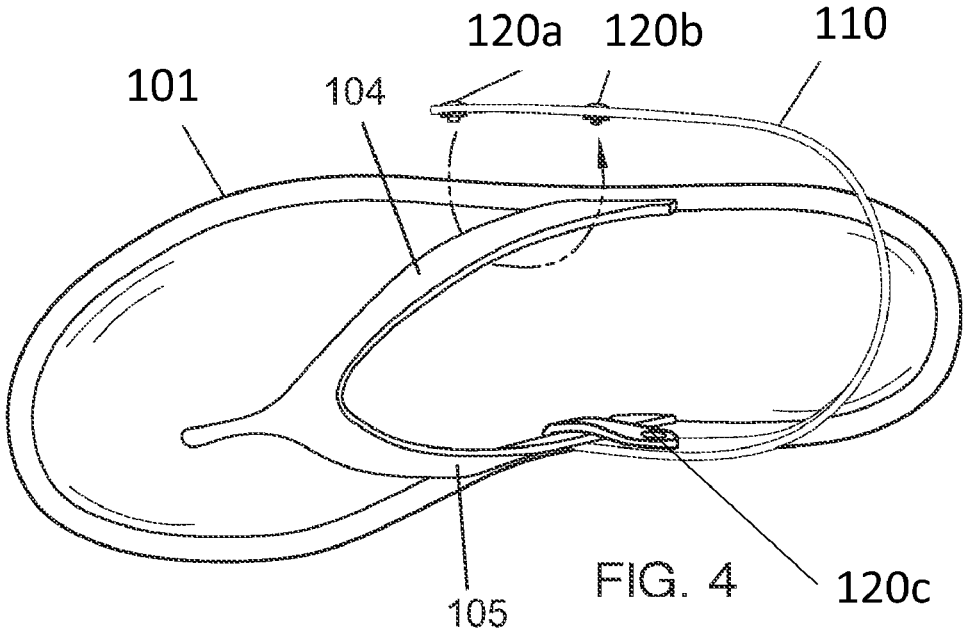
FIG. 4 is a top view of the back strap device of FIG. 1.
Figure 5:
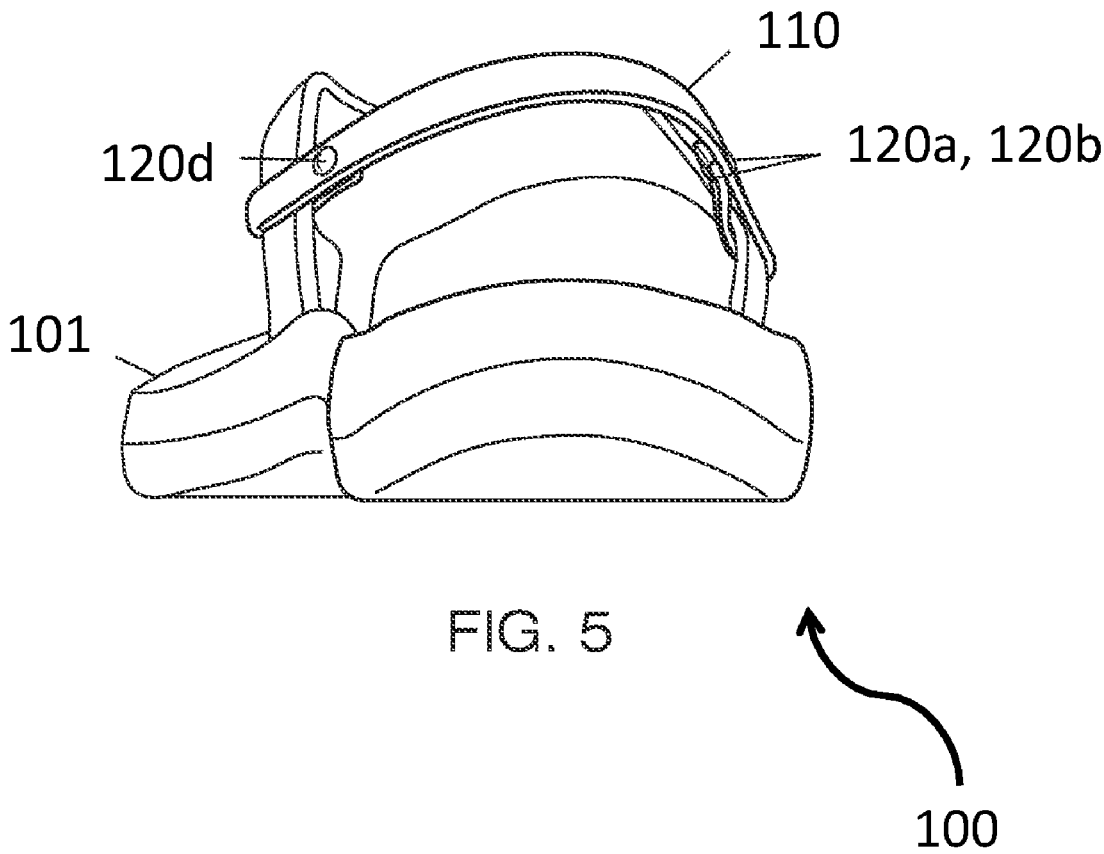
FIG. 5 is a back view of the back strap device of FIG. 1.

Referring now to FIGS. 1-5, the present invention features a back strap device 100 for attaching to flip-flops, sandals, thongs, and the like. The device 100 of the present invention helps to keep the flip-flop, sandals, or thong secured to the user's foot. The back strap device 100 may be constructed in a variety of colors and/or designs (e.g., for coordinating with a user's wardrobe). For example, in some embodiments, the back strap device 100 is decorated with jewels, logos, sports names, characters, patterns, the like, or a combination thereof. The flip flop 101 comprises a front end rear end. The flip flop further comprises a Y-shaped strap 102 with a stem 103, a first arm 104 and a second arm 105, wherein the stem terminates and secures to the front end of the flip flop 101, the first arm 104 terminates and secures to one side of the rear end of the flip flop, the second arm 105 terminates and secures to the opposite side of the rear end of the flip flop.

The device 100 of the present invention comprises an elongated strap 110 having a first end and a second end, and an outer surface and an inner surface (when attached to the flip flop, sandal, thong, or the like, the outer surface faces outwardly and the inner surface faces the user's heel). Disposed on the outer surface of the strap 110 at the first end is a first half snap 120*a*. Disposed on the outer surface of the strap 110 near the first end (spaced a certain distance away from the first half snap 120*a*) is a second half snap 120*b*. Disposed on the outer surface of the strap 110 at the second end is a third half snap 120*c*. Disposed on the outer surface of the strap 110 near the second end (spaced a certain distance away from the third half snap 120*c*) is a fourth half snap 120*d*. The first half snap 120*a*can engage the second half snap 120*b* by bending the first end of the strap 110 around to form an enclosed loop such that the first arm 104 of the flip-flop 101 is wrapped inside the loop, and the third half snap 120*c* can engage the fourth half snap 120*d* by bending the second end of the strap 110 around to form another enclosed loop such that the second arm 105 of the flip-flop 101 is wrapped inside the loop. This allows a user to attach the strap 110 to a flip flop, thong, sandal, or the like (see FIG. 1, FIG. 2).

The strap 110 may be constructed in a variety of sizes. For example, in some embodiments, the strap 110 is between about 6 to 10 inches in length as measured from the first end to the second end. As used herein, the term "about" refers to plus or minus 10% of the referenced number. For example, an embodiment wherein the strap 110 is about 10 inches in length includes a strap 110 that is between 9 and 11 inches in length. In some embodiments, the strap 110 is adjustable in length to accommodate one's level of comfort.

As an example, in some embodiments, the strap 110 may be about 6 inches in length for children (e.g., shoe size 12-2). In some embodiments, the strap 110 may be about 7 inches in length for children or adults (e.g., shoe size 3 kids to adult 6). In some embodiments, the strap 110 may be about 8 inches in length for men or women (e.g., shoe size 7-9). In some embodiments, the strap 110 may be about 10 inches in length for men or women (e.g., shoe size 10-12).

Without wishing to limit the present invention to any theory or mechanism, it is believed that the device 100 of the present invention is advantageous because the pairs of snaps 120 on each end of the strap 110 allow for easy attachment to and removal from a flip flop, sandal, thong, or the like.

The following the disclosures of the following U.S. Patents are incorporated in their entirety by reference herein: U.S. Pat. No. 7,439,837; U.S. Pat. application No. 2005/0252036; U.S. Pat. No. 6,516,538; U.S. Pat. No. 7,331,122; U.S. Pat. No. 2,112,761; U.S. Pat. No. 5,992,058.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A flip-flop system consisting of:

(a) The flip flop comprises a front end rear end, wherein the flip-flop further comprises a Y-shaped strap with a stem, a first arm and a second arm, wherein the stem terminates and secures to the front end of the flip flop, the first arm terminates and secures to one side of the rear end of the flip flop, the second arm terminates and secures to the opposite side of the rear end of the flip flop;

(b) an elongated strap having a first end, a second end, an outer surface, and an inner surface, the elongated strap being between about 6 to 10 inches in length as measured from the first end to the second end;

(c) a first half snap disposed on the outer surface of the strap at the first end and a second half snap disposed on the outer surface of the strap near the first end spaced a certain distance away from the first half snap, the first half snap engages the second half snap by bending the first end of the strap around to form an enclosed loop such that the said first arm of the flip-flop is wrapped inside the loop and slide within the enclosed loop; and (d) a third half snap disposed on the outer surface of the strap at the second end and a fourth half snap disposed on the outer surface of the strap near the second end spaced a certain distance away from the third half snap, the third half snap engages the fourth half snap by bending the second end of the strap around to form a second enclosed loop such that the said second arm of the flip-flop is wrapped inside the second loop, the snaps function to the elongated strap to be removably attached to the said flip-flop and slide within the enclosed loop.

2. The flip-flop system of claim 1, wherein the elongated strap is adjustable in length.

* * * * *